US005250230A

United States Patent [19]

Steele et al.

[11] Patent Number: 5,250,230

[45] Date of Patent: Oct. 5, 1993

[54] COMPOSITION AND PROCESS FOR CLEANING METALS

[75] Inventors: Duane C. Steele; William C. Strickland, both of Sterling Heights, Mich.

[73] Assignee: Henkel Corporation, Plymouth Meeting, Pa.

[21] Appl. No.: 811,756

[22] Filed: Dec. 20, 1991

[51] Int. Cl.[5] ..... C11D 3/30; C11D 7/32; C11D 3/075

[52] U.S. Cl. ..... 252/544; 252/174.14; 252/174.15; 252/174.16; 252/174.22

[58] Field of Search ..... 252/544, 174.14, 174.15, 252/174.16, 174.22

[56] References Cited

U.S. PATENT DOCUMENTS

| | | | |
|---|---|---|---|
| 3,696,057 | 11/1972 | Schussler et al. | 252/544 |
| 4,474,682 | 10/1984 | Billenstein et al. | 252/344 |
| 4,554,099 | 11/1985 | Clarke | 252/174.22 |
| 4,826,618 | 5/1989 | Borseth et al. | 252/174.21 |
| 5,076,954 | 12/1991 | Loth et al. | 252/174.19 |
| 5,108,643 | 4/1992 | Loth et al. | 252/174.19 |
| 5,110,494 | 5/1992 | Beck | 252/174.15 |
| 5,126,068 | 6/1992 | Burke et al. | 252/174.21 |

FOREIGN PATENT DOCUMENTS

| | | | |
|---|---|---|---|
| 1160534 | 1/1974 | Canada | 252/544 |

OTHER PUBLICATIONS

D. Meyer—Surfactant Science and Technology . . . pp. 236–237.

*Primary Examiner*—Paul Lieberman
*Assistant Examiner*—David A. Zarneke
*Attorney, Agent, or Firm*—Ernest G. Szoke; Wayne C. Jaeschke; Norvell E. Wisdom, Jr.

[57] ABSTRACT

The oil splitting properties of otherwise conventional alkaline cleaning solutions that comprise water, an alkaline builder, and a general surfactant component are substantially improved by adding a special, nonionic, surfactant component that has an HLB value in the range from 1 to 7.9 and is made up of molecules that contain at least two nitrogen atoms per molecule and have a chemical structure that can be made by sequential additions of ethylene oxide followed by propylene oxide, or of propylene oxide followed by ethylene oxide, to core molecules that are most preferably 1,2-diaminoethane but more generally may be any organic amine that contains at least two primary and/or secondary amino groups and contains not more than 22 carbon atoms.

20 Claims, No Drawings

COMPOSITION AND PROCESS FOR CLEANING METALS

BACKGROUND OF THE INVENTION

1. Field of the Invention

The invention relates to a process for separating oil that accumulates in alkaline cleaning solutions used to clean metal parts contaminated with oil or similar materials widely used as lubricants in machining and/or as temporary protection against corrosion. Such oily materials normally must be substantially totally removed from metal surfaces in order to prepare them for uniform formation on the surface of a coating that will provide long term protection against corrosion.

The term "alkaline cleaning solutions" as used herein includes all aqueous solutions that contain dissolved alkali or alkaline earth metal hydroxides, carbonates, borates, phosphates, or silicates. The borates, phosphates, and silicates in this class include both simple and condensed types, such as metasilicate, pyrophosphate and tripolyphosphate, and borax and the like. The alkali and alkaline earth metals include sodium, potassium, magnesium, calcium, barium, and the like. Alkaline cleaning solutions of this type can be adapted to specific uses by choosing specific mixtures and ratios of the borate, hydroxide, phosphate, silicate, and/or carbonate constituents. Thus, for certain end uses, phosphates may be preferred to carbonates, silicates may be used exclusive of the other alkaline salts, or, more often, combinations of hydroxides and one of the less strongly alkaline salts, which may be utilized in widely varying ratios to each other, will be preferred.

Many alkaline cleaning solutions of this type, usually also including suitable surfactants and, optionally, sequestering agents (which are usually also chelating agents), are known in the prior art, are commercially available and are widely used for removing oily type soils from metals. Cleaners of this type are very effective when freshly formulated, but when repeatedly reused eventually accumulate so much dispersed and/or emulsified oil that their cleaning performance becomes unsatisfactory. To avoid the expense of replacing the alkaline salts and other constituents, separation of the oil from such used cleaning solutions is desirable.

2. Statement of Related Art

Normally, alkaline cleaner compositions now used for metal surface preparation contain a surfactant component, which may be a single chemical type of surfactant or a mixture of such chemical types, including any or all of the classes of anionic, cationic, amphoteric, and nonionic surfactants. (Cationic surfactants are less commonly used than the other types in metal cleaning formulations, because they are more likely to affect the subsequent processing and treatment of the metal surface in some manner that may be adverse.)

Surfactants and surfactant mixtures that make very stable emulsions of oil in water are very effective for cleaning but present almost insurmountable difficulties when attempting to separate the oil from the emulsion in such a manner as to make it possible to reuse most of the water phase and its cleaning effective contents. Special splitting promoting reagents such as cationic surfactants are commonly added to spent cleaning solutions of this type as part of waste treatment, to avoid discharging oil to water runoff.

Surfactants and surfactant mixtures that are more commonly used in practical metal cleaning operations make semi-stable to moderately stable emulsions. The rapid mechanical motion associated with normal cleaning processes such as spraying aids in dispersing and/or emulsifying oil even into an aqueous phase where it is relatively weakly emulsified. The much more quiescent conditions of a large holding tank or reservoir for the cleaning solution that is commonly provided as part of the cleaning equipment provide an opportunity for weakly emulsified oil to separate from the aqueous cleaner and rise to the surface of the tank, from which it can be removed by skimming and/or controlled overflow of a fraction of the tank contents. However, the spontaneous separation of the oil in this manner, otherwise known as "oil splitting", is usually both slower and less complete than would be desirable, with cleaning solutions containing the presently conventional surfactants. This is especially true when cleaning corrosion protective oils, which often contain materials that can act as emulsifiers or emulsion stabilizers for the oils in an alkaline cleaning solution. One object of this invention is to improve the speed and/or effectiveness of oil splitting from alkaline cleaning solutions, without substantially diminishing their effectiveness in cleaning.

A large field of art that might be considered related, although it actually has significant technical distinctions, is that of breaking emulsions of water in oil, particularly as part of petroleum extraction and recovery. As a consequence of the difference in the nature of the continuous phase of the emulsions, it is doubtful that such art is sufficiently closely related to be of value in attempting to improve oil splitting in emulsions of oil in water. However, as a matter of interest it is noted that such art as U.S. Pat. No. b 4,474,682 of Oct. 2, 1984 to Billenstein et al. teaches the use of ethoxylated and propoxylated polyethylene polyamines as emulsion breakers for water in oil emulsions.

DESCRIPTION OF THE INVENTION

Except in the claims and the operating examples, or where otherwise expressly indicated all numerical quantities in this description indicating amounts of material or conditions of reaction and/or use are to be understood as modified by the word "about" in describing the broadest scope of the invention. Practice within the exact numerical limits stated is generally preferred.

SUMMARY OF THE INVENTION

It has been found that alkaline cleaning solution have oil splitting properties that are superior to those of currently conventional alkaline cleaning solutions if they comprise, preferably consist essentially of, or more preferably consist of water and;

(A) an alkaline salt component (alternatively called "alkalinizing component");

(B) a special surfactant component that (i) consists of nonionic surfactants, (ii) has an HLB value in the range from 1 to 7.9, (iii) consists of molecules with at least two and preferably exactly two nitrogen atoms per molecule, (iv) has a chemical structure that can be made by sequential additions of ethylene oxide followed by propylene oxide, or of propylene oxide followed by ethylene oxide, to a component of core molecules that (a) are most preferably ethylene diamine (i.e., 1,2-diaminoethane) but more generally may be any organic amine that contains at least two primary and/or secondary amino group, preferably primary amino groups, (b) with increasing preference in the order stated contains not more than 22, 18, 12, 6, 4, 3, or 2 carbon atoms, and, preferably, (c) contains no other functional groups;

(C) a general surfactants component selected from the group consisting of:

(a) nonionic surfactants exclusive of those that have a chemical structure that can be made by sequential additions of ethylene oxide followed by propylene oxide, or of propylene oxide followed by ethylene oxide, to a component of core molecules, said core molecules being organic amines that (i) contain at least two amino groups, each of which contains at least one N—H bond, and (ii) contain not more than 22 carbon atoms;

(b) anionic surfactants, cationic surfactants, and amphoteric surfactants; and (c) mixtures thereof; and, optionally, (D) a sequestering agent and/or chelating agent.

(Note: If the HLB value for a particular commercial non-ionic surfactant or mixture of surfactants is given as a range and the chemical formula is not known, the arithmetic mean of the ends of the range is considered to be the single HLB value for the material for the purposes of the definition of this invention. If the chemical formula of a nonionic surfactant is known, the HLB value for the purposes of the definition of this invention is to be calculated by the methods described in D. Meyer, *Surfactant Science and Technology* {VCH Publishers, New York and Weinheim, 1988},formulas 6–10 and 6–11 and Table 6.2 on pages 236–237.)

The improvement in oil splitting obtained by formulating alkaline cleaners as described above is not accompanied by any significant reduction in cleaning effectiveness, compared with otherwise conventional cleaners.

Various embodiments of the invention include cleaning compositions as noted above, liquid and solid concentrates from which such working cleaning compositions may be prepared by dilution with water only, and processes for using the working cleaning compositions.

DESCRIPTION OF PREFERRED EMBODIMENTS

Preferred alkalinizing agents include sodium and potassium hydroxides, carbonates, silicates, borates, and phosphates. The potassium salts are equally as useful technically as the sodium salts but are usually slightly less preferred because they generally are more expensive. It is particularly preferred for the compositions according to this invention to use a combination of hydroxides with one or more of the group of carbonates, phosphates, silicates, and borates.

Preferred nonionic amine based surfactants for the special surfactant component as defined above are also readily available commercially, for example under the name TETRONIC TM from BASF Corp. and under the name GENAPOL TM from Hoechst Celanese Corp. The ratio by weight of the general surfactant component to the total alkalinizing component in the compositions is preferably in the range from 1:100 to 1:5, more preferably from 1:50 to 1:10, or still more preferably from 1:26 to 1:12. The ratio by weight of the special surfactant component to the general surfactant component is preferably in the range from 0.05:1.0 to 1:0:1:0, more preferably from 0.2:1.0 to 0.7:1.0, or still more preferably from 0.35:1.0 to 0.65:1.0.

Suitable sequestering agents include but are not limited to sorbitol, mannitol, gluconates, citrates, glucoheptonates, ethylene diamine tetraacetic acid ("EDTA"), nitrilotriacetic acid ("NTA"), and other water soluble organic compounds containing at least two carboxyl, phosphonate, and/or hydroxyl groups, and salts, particularly the potassium and sodium salts, of such compounds that are acids. Mixtures of these materials may also be used. Gluconates, heptogluconates, EDTA, NTA, sorbitol, and/or mannitol are preferred. The ratio by weight of sequestering agents to the total alkaline salt component in the compositions is preferably in the range from 1:100 to 1:5, more preferably from 1:50 to 1:10, or still more preferably from 1:40 to 1:16.

A working cleaning composition according to the invention preferably has a free alkalinity in the range from 2 to 50 points, more preferably from 2 to 30 points, or still more preferably from 3 to 20 points. The points of free alkalinity are defined as equivalent to the number of milliliters (hereinafter "ml") of 0.1N strong acid required to titrate a 10 ml sample of the composition to a phenolphthalein endpoint.

Cleaning according to the invention is preferably performed by spraying the surfaces to be cleaned with a working cleaning composition maintained at a temperature between 30° C. and 90° C., more preferably between 43° C. and 82° C., or still more preferably between 49° C. and 77° C.

Further appreciation of the present invention may be had from the following examples and comparison examples which are intended to illustrate, but not limit, the invention.

CONCENTRATE COMPOSITION EXAMPLES AND COMPARISON

Examples 1–5

The solid compositions shown under numbers 1–5 in Table 1 below were prepared. Compositions 4–4 were solids and composition 5 was a liquid. Part A shown under each number was a composition according to currently conventional art, while part B was a composition according to the present invention.

The compositions described in Table 1 were subjected to a laboratory simulation of oil splitting after practical use according to the following procedure: The concentrates were dissolved or diluted in sufficient water to produce a simulated working solution with 15 points of free alkalinity. A volume of conventional oil for protecting metal surfaces temporarily against corrosion (Quaker Type 61AUS) corresponding to 1% of the volume of the simulated working solution was then added to the simulated working solution. This was mixed by pumping the oil containing simulated working solution from a holding tank through a multiple spray nozzle system of a type conventionally used for practical alkaline cleaning lines for ten minutes, during which time the entire six liter volume of the oil containing simulated working cleaning solution passed through a group of twenty-four spray nozzles, each of which had a spray volume of 0.65 liters per minute. A sample with a volume of 89 ml was taken from the holding tank immediately after discontinuing the spraying and placed in a capped clear bottle with about 120 ml capacity. After intervals of 5 and 60 minutes after the bottling of these samples, the presence or absence of a second phase layer floating on top of the bulk of the sample was observed, as was the type of any such small upper phase and the degree of turbidity of the bulk of the sample. The results of these observations are reported in Table 2.

The results in Table 2 show that the addition of the second, relatively low HLB value surfactant improves the degree of spontaneous separation of the oil content from the simulated cleaning solution on standing, as evidenced by the amount and clarity of the second phase separated, the greater clarity of the water phase (indicating less oil entrained therein), or both.

TABLE 1

COMPOSITIONS OF CONCENTRATES ACCORDING TO THE INVENTION AND COMPARISON EXAMPLES

| Component | Parts by Weight of Component in Composition: | | | | | | | | | |
|---|---|---|---|---|---|---|---|---|---|---|
| | 1A | 1B | 2A | 2B | 3A | 3B | 4A | 4B | 5A | 5B |
| NaOH | 40.0 | 38.8 | 40.0 | 39.1 | 40.0 | 39.1 | 46.9 | 45.5 | — | — |
| KOH[1] | — | — | — | — | — | — | — | — | 52 | 52 |
| $Na_2CO_3$ | 43.0 | 41.7 | 52.9 | 51.8 | 52.9 | 51.8 | — | — | — | — |
| $Na_4P_2O_7$ | 7.0 | 6.8 | — | — | — | — | — | — | — | — |
| $Na_5P_3O_{10}$ | — | — | — | — | — | — | 45.9 | 44.4 | 5 | 5 |
| $NaC_6O_7H_{11}$[2] | 5.0 | 4.7 | 2.1 | 2.1 | 2.1 | 2.1 | 2.2 | 2.1 | 3 | 3 |
| PLURONIC TM L43 | 5.0 | 5.0 | 5.0 | 5.0 | — | — | 5.0 | 5.0 | — | — |
| ANTAROX TM LF330 | — | — | — | — | 5.0 | 5.0 | — | — | — | — |
| TRITON TM DF-20 | — | — | — | — | — | — | — | — | 3 | 3 |
| TETRONIC TM 701 | — | 3.0 | — | 2.0 | — | 2.0 | — | 3.0 | — | 2 |
| Deionized Water | — | — | — | — | — | — | — | — | 37 | 35 |

Notes for Table 1

PLURONIC TM L43 is commercially available from BASF Corp. It is reported by its manufacturer to be a block copolymer of ethylene oxide and propylene oxide with an HLB value of 7.0–12.0.

ANTAROX TM LF330 is commercially available from Rhône-Poulenc. It is reported by McCutcheon's Emulsifiers and Detergents (1989 ed.) to be a "modified linear aliphatic polyether" nonionic type surfactant and is believed to have an HLB value of about 11.

TRITON TM DF-20 is commercially available from Union Carbide Corp. It is reported by McCutcheon's Emulsifers and Detergents (1989 ed.) to be a "modified ethoxylate" anionic type surfactant.

TETRONIC TM 701 is commercially available from BASF Corp. It is reported by its manufacturer to be a block copolymer of ethylene oxide and propylene oxide on a base of ethylene diamine with an HLB value of 1.0–7.0.

[1]Liquid 45% aqueous solution of potassium hydroxide

[2]Sodium gluconate

TABLE 2

DEGREE OF SEPARATION AND WATER PHASE CLARITY RATINGS

| Example and Comparison Example Numbers | Clarity Rating After: | | Degree of Separation After: | |
|---|---|---|---|---|
| | 5 Minutes | 60 Minutes | 5 Minutes | 60 Minutes |
| 1A | 5 | 4 | 0 | – |
| 1B | 3 | 3 | ++ | +++ |
| 2A | 4 | 4 | 0 | – |
| 2B | 4 | 3 | ++ | +++ |
| 3A | 5 | 4 | 0 | – |
| 3B | 4 | 3 | 0 | + |
| 4A | 4 | 4 | ++ | +++ |
| 4B | 3 | 3 | ++ | +++ |
| 5A | 5 | 5 | 0 | – |
| 5B | 3 | 3 | +++ | +++ |

Ratings Key for Table 2

Clarity Ratings: 3 = clearly translucent; 4 = barely translucent; 5 = opaque

Degree of Separation Ratings: +++ = relatively thick transparent upper oil layer, no underlying creamy layer; ++ = thin transparent upper oil layer, no underlying creamy layer; + = slight transparent upper oil layer with underlying creamy upper layer; – = no visible transparent upper oil layer, but a creamy upper layer present; 0 = no detectable phase separation.

What is claimed is:

1. A composition of matter consisting essentially of:

(A) a water soluble alkalinizing component;

(B) a first water soluble or water dispersible surfactant component that:

(a) has an HLB value in the range from 1 to 7.9; and (b) consists of molecules that contain at least two nitrogen atoms per molecule and have a chemical structure that can be made by sequential additions of ethylene oxide followed by propylene oxide, or of propylene oxide followed by propylene oxide, to a core molecule that is an organic amine which (i) contains at least two amino groups, each of which has at least one N—H bond, and (ii) contains not more than 22 carbon atoms;

(c) a second component of water soluble or water dispersible surfactants selected from the group consisting of:

(a) nonionic surfactants exclusive of those that have a chemical structure that can be made by sequential additions of ethylene oxide followed by propylene oxide, or of propylene oxide followed by ethylene oxide, to a component of core molecules, said core molecules being organic amines that (i) contain at least two amino groups, each of which contains at least one N—H bond, and (ii) contain not more than 22 carbon atoms;

(b) anionic surfactants and amphoteric ionic surfactants; and (c) mixtures thereof; and optionally, (D) a component of sequestering agent; and optionally, (E) water, wherein the ratio by weight of component (C) to component (A) is in the range from about 1:100 to about 1:5 and the ratio by weight of component (B) to component (C) is in the range from about 0.35:1.0 to about 0.65:1.0.

2. A composition according to claim 1, wherein component (D) is selected from the group consisting of sorbitol; mannitol; gluconic, citric, and glucoheptonic acids, EDTA, and NTA and salts thereof; and mixtures thereof, and the ratio by weight of component (D) to component (A) is in the range from about 1:100 to about 1:5.

3. A composition according to claim 1, wherein the ratio by weight of component (D) to component (A) is in the range from about 1:100 to about 1:5.

4. A composition according to claim 3, wherein component (A) consists of a combination of a sub-component (A)(1) selected from the group consisting of sodium hydroxide, potassium hydroxide, and mixtures thereof and a sub-component (A)(2) selected from the group consisting of sodium and potassium carbonates, phosphates (including condensed phosphates), borates (including condensed borates), silicates (including condensed silicates), and mixtures thereof.

5. A composition according to claim 2, wherein component (A) consists of a combination of sub-component (A)(1) selected from the group consisting of sodium hydroxide, potassium hydroxide, and mixtures thereof and a sub-component (A)(2) selected from the group consisting of sodium and potassium carbonates, phosphates (including condensed phosphates), borates (including condensed borates), silicates (including condensed silicates), and mixtures thereof.

6. A composition according to claim 1, wherein component (A) consists of a combination of a sub-component (A)(1) selected from the group consisting of sodium hydroxide, potassium hydroxide, and mixtures thereof and a sub-component (A)(2) selected from the group consisting of sodium and potassium carbonates, phosphates (including condensed phosphates), borates (including condensed borates), silicates (including condensed silicates), and mixtures thereof.

7. A composition according to claim 6, wherein:

the ratio by weight of component (C) to component (A) is in the range from about 1:50 to about 1:10;

component (B) consists of surfactants that can be made by sequential additions of ethylene oxide followed by propylene oxide, or of propylene oxide followed by ethylene oxide, to ethylene diamine; and the ratio by weight of component (D) to component (A) is in the range from about 1:50 to about 1:10.

8. A composition according to claim 5, wherein:

the ratio by weight of component (C) to component (A) is in the range from about 1:26 to about 1:12;

component (B) consists of surfactants that can be made by sequential additions of ethylene oxide followed by propylene oxide, or of propylene oxide followed by ethylene oxide, to ethylene diamine; and the ratio by weight of component (D) to component (A) is in the range from about 1:40 to about 1:16.

9. A composition according to claim 4, wherein:

the ratio by weight of component (C) to component (A) is in the range from about 1:26 to about 1:12;

component (B) consists of surfactants that can be made by sequential additions of ethylene oxide followed by propylene oxide, or of propylene oxide followed by ethylene oxide, to ethylene diamine; and the ratio by weight of component (D) to component (A) is in the range from about 1:40 to about 1:16.

10. A composition according to claim 3, wherein:

the ratio by weight of component (C) to component (A) is in the range from about 1:50 to about 1:10;

component (B) consists of surfactants that can be made by sequential additions of ethylene oxide followed by propylene oxide, or of propylene oxide followed by ethylene oxide, to ethylene diamine; and the ratio by weight of component (D) to component (A) is in the range from about 1:40 to about 1:16.

11. A composition according to claim 2, wherein:

the ratio by weight of component (C) to component (A) is in the range from about 1:50 to about 1:10;

component (B) consists of surfactants that can be made by sequential additions of ethylene oxide followed by propylene oxide, or of propylene oxide followed by ethylene oxide, to ethylene diamine; and the ratio by weight of component (D) to component (A) is in the range from about 1:50 to about 1:10.

12. A composition according to claim 1, wherein:

the ratio by weight of component (C) to component (A) is in the range from about 1:50 to about 1:10;

component (B) consists of surfactants that can be made by sequential additions of ethylene oxide followed by propylene oxide, or of propylene oxide followed by ethylene oxide, to ethylene diamine; and the ratio by weight of component (D) to component (A) is in the range from about 1:50 to about 1:10.

13. A composition according to claim 7 wherein water is included and the free alkalinity is in the range from 3 to 20 points.

14. A composition according to claim 1 wherein water is included and the free alkalinity is in the range from 2 to 50 points.

15. A composition according to claim 8 wherein water is included and the free alkalinity is in the range from 3 to 20 points.

16. A composition according to claim 9 wherein water is included and the free alkalinity is in the range from 2 to 30 points.

17. A composition according to claim 8 wherein water is included and the free alkalinity is in the range from 2 to 30 points.

18. A composition according to claim 11 wherein water is included and the free alkalinity is in the range from 2 to 30 points.

19. A composition according to claim 10 wherein water is included and the free alkalinity is in the range from 2 to 30 points.

20. A composition according to claim 2 wherein water is included and the free alkalinity is in the range from 2 to 50 points.

* * * * *